US008206665B2

(12) United States Patent
Tsutsumi et al.

(10) Patent No.: US 8,206,665 B2
(45) Date of Patent: Jun. 26, 2012

(54) CAP FOR MICROTUBE FOR PHARMACEUTICAL DEVELOPMENT

(75) Inventors: Kazuhiro Tsutsumi, Osaka (JP); Hisao Nishii, Osaka (JP); Yukio Ueyama, Hyogo (JP)

(73) Assignee: Tsubakimoto Chain Co., Osaka (JP)

( * ) Notice: Subject to any disclaimer, the term of this patent is extended or adjusted under 35 U.S.C. 154(b) by 121 days.

(21) Appl. No.: 12/396,552

(22) Filed: Mar. 3, 2009

(65) Prior Publication Data

US 2009/0226345 A1 Sep. 10, 2009

(30) Foreign Application Priority Data

Mar. 5, 2008 (JP) ..... 2008-054884

(51) Int. Cl.
*B01L 3/00* (2006.01)
*A47F 7/00* (2006.01)

(52) U.S. Cl. ..... 422/552; 211/85.13

(58) Field of Classification Search ..... 422/552; 211/85.13

See application file for complete search history.

(56) References Cited

U.S. PATENT DOCUMENTS

| | | | | |
|---|---|---|---|---|
| 3,635,325 | A | 1/1972 | Sterling | |
| 3,756,402 | A * | 9/1973 | Wagers et al. | 209/541 |
| 5,112,574 | A | 5/1992 | Horton | |
| 6,565,814 | B1 * | 5/2003 | Anraku et al. | 422/102 |
| 2001/0036426 | A1 * | 11/2001 | Kohrmann et al. | 422/130 |

FOREIGN PATENT DOCUMENTS

| | | |
|---|---|---|
| EP | 1132135 | 9/2001 |
| GB | 882146 | 11/1961 |
| GB | 2 108 943 | 5/1983 |
| JP | 2001-330537 | 11/2001 |
| JP | 2003-279586 | 2/2003 |
| JP | 2007-033061 | 2/2007 |

OTHER PUBLICATIONS

EP Search Report dated Jun. 23, 2009.
List of Cited Documents with Relevant Parts of the Office Action dated Aug. 3, 2010 of JP Application 2008-054884.

* cited by examiner

*Primary Examiner* — Lore Jarrett
(74) *Attorney, Agent, or Firm* — Dann Dorfman Herrell & Skillman; Henry H. Skillman

(57) ABSTRACT

A cap for a microtube, which can be automatically aligned by an alignment plate for insertion in a correct orientation into the open end of the microtube held in a micro tube rack. The plate has partitions in a grid which produces a matrix of cells having a pitch defined by the spacing between the partitions. The cap 100 has an plug portion 120, which is adapted to be inserted into the open end of the microtube which is held in a rack having a matrix of wells congruent with the matrix of cells in the alignment plate. A grip portion 110 of the cap has an outer circumferential diameter larger than an outer circumferential diameter of the plug portion 120, so that when the cap is inserted in the microtube, the grip portion protrudes from the open end of the microtube. The entire length of the cap 100 is longer than the pitch of the alignment plate and shorter than twice the pitch. An upper edge of the grip portion 110 of the cap 100 has a collar 130 with an outer circumferential diameter larger than the diameter of the cells of the alignment plate. The plug portion 120 of the cap 100 has a taper 122 which is tapered toward a front end, and the center of gravity of the cap 100 is in the plug portion, so that the plug portion of the cap gravitates into one of the open cells of the alignment plate.

6 Claims, 9 Drawing Sheets

CAP FOR MICROTUBE FOR PHARMACEUTICAL DEVELOPMENT

FIELD OF INVENTION

The present invention relates to a microtube for pharmaceutical development used for sealing samples in a field of researches of pharmaceutical development, and more specifically, it relates to a cap for a microtube having a shape suitable for aligning caps by an alignment plate having the same pitch as a storage rack for simultaneously capping and closing the open ends of a plurality of microtubes, accommodated in the wells of a microtube rack.

BACKGROUND OF THE INVENTION

In the field of research for pharmaceutical development, during tests, it is necessary to store a large number of samples at low temperature and to analyze them at high efficiency. Therefore, the storage and transportation of a storage rack has been carried out by sealing or encapsulating a sample-dissolved solution in a cylindrical- or a rectangular-tubular small vessel, called a microtube and depositing the microtubes into the storage rack partitioned into the total of 384 wells in a matrix with 16 rows and 24 columns in accordance with a standard of SBS (Society for Biomolecular Screening) (see for example, Japanese Patent Publication No. 2007-33061 (page 6, paragraphs 25 to 26, FIG. 1).

Such a storage rack having the 384 wells in accordance with the standard of SBS has very short well pitch of 4.5 mm. When a removable cap is used for closing open ends of microtubes accommodated into the storage rack, mounting of caps by a machine simultaneously was very difficult. Thus the caps each must be mounted on the tubes and much labor and time have been needed for mounting caps on all open ends of the 384 microtubes in the storage rack.

The present inventors have invented a new method of mounting a cap on the microtube comprising the steps of previously aligning caps of microtubes on an alignment plate with cells having the same pitch as the wells in the storage rack, and overlying this alignment plate on the storage rack. The caps aligned on the alignment plate are pushed into the open tops of the microtubes accommodated in the storage rack, so that the cells overlie the wells of the storage rack. The caps are permitted to be passed through the alignment plate by the resilient compressibility of the cap, so that the open tops of all microtubes deposited in the storage rack are closed with caps simultaneously. The present inventors have developed a cap alignment device for aligning caps on an alignment plate in short time, so as to carry out the above-mentioned method of mounting a cap efficiently (see Japanese Patent Application No. JP2008-46092).

PROBLEMS TO BE SOLVED BY THE INVENTION

However, in a case where when caps of microtubes are aligned on an alignment plate by use of this cap alignment device and conventional caps are used, there are some unaligned caps which drop into the alignment plate in a reversed state or laterally. Thus it took much time for realigning such unaligned caps individually.

Further, when microtubes with caps are accommodated in a storage rack in tight rows, since there are no spaces between adjacent microtube caps at all, it was difficult to pull microtubes from the storage rack.

Further, it has been feared that the conventional caps have low airtightness with the open ends of the microtubes and samples in the microtubes ooze through edges of the open ends of the microtubes.

Further, the grip portion of the conventional cap is small it was difficult to grip manually.

Accordingly, the technical problems to be solved by the present invention that is the object of the present application is to provide a cap for a microtube, which can be aligned in a correct orientation in a short time when the caps are being aligned on an alignment plate by use of a cap alignment device, can allow the microtubes to be easily pulled from a storage rack either automatically or manually, and can provide high airtightness.

SUMMARY OF THE INVENTION

The invention solves the above-described problems by an improved cap for a microtube, which the caps adapted to be aligned on an alignment plate having receptacles with the same pitch as a storage rack, so that the alignment plate may be placed over the open microtubes vertically accommodated storage rack. The caps are simultaneously pushed out of the alignment plate into the open ends of the microtubes to close the open ends. Each cap has a plug portion, which is inserted into the open end of the microtube and a grip portion having an outer circumferential diameter larger than an outer circumferential diameter of the plug portion, so as to protrude from the open end of the microtube. The entire length of the cap is longer than the pitch of the alignment plate and shorter than twice of the pitch. An upper edge of the grip portion of the cap has a collar with an outer circumferential diameter larger than the receptacles of the alignment plate. The plug portion of the cap has a tapered end part which is tapered toward the front end, and the center of gravity of the cap is in the plug portion side.

The invention further solves the above-described problems by that, in the cap for a microtube, a concave receptacle for inserting a picking shaft bar is formed on an upper surface of the grip portion of the cap.

It is noted that the "picking shaft bar" in the present invention is made of iron or the like and is a generic name of a bar-shaped jig, which fits into a concave receptacle formed in the upper surface of the grip portion of the cap so that picking of the cap and/or the capped microtube can be performed.

The invention further solves the above-described problems by providing in the cap for a microtube a shoulder at a boundary between the plug portion and the grip portion, and a circumferential groove, which does not come into intimate contact with an inner wall of the open end of the microtube, in the vicinity of the boundary.

The invention further solves the above-described problems by providing a cap for a microtube in which the length of the grip portion of the cap is longer than the length of the plug portion.

EFFECTS OF THE INVENTION

According to the invention when the caps for microtubes are aligned on an alignment plate of the same pitch as a storage rack, and after the alignment plate is placed over the storage rack, the caps are pushed through the plate into open ends of the microtubes to simultaneously close the open ends. Each cap has a plug portion, which is inserted into the open end of the microtube and a grip portion having an outer circumferential diameter larger than an outer circumferential diameter of the plug portion, and protruding from the open end of the microtube. The entire length of the cap is longer than a pitch of the alignment plate and shorter than twice of the pitch. An upper edge of the grip portion of the cap has a collar with an outer circumferential diameter greater than the receptacles of the alignment plate. The plug portion of the cap has a front part which has a taper which is tapered toward a front end. The center of gravity of the cap is in the plug portion side. The shape and dimensions of the cap insure that they are easily inserted into sections of the alignment plate in a correct orientation. Thus, the cap can be very efficiently aligned into the alignment plate by use of the automated cap alignment device.

According to the invention according, a concave receptacle for inserting a picking shaft bar is formed in an upper surface of the grip portion of the cap. A microtube deposited in the storage rack may be pulled out only by inserting the picking shaft bar into the concave receptacle, so that the handling performance of the microtube is significantly improved. Further, the pulling out the microtube can be mechanized by a simple device configuration without use of a complicated picking mechanism.

Further, a shoulder is formed at a boundary between the plug portion and the grip portion of the cap and a groove, which does not come into intimate contact with an inner wall of the open end of the microtube, is formed adjacent the boundary between the grip portion and the plug portion. The contact surface between an outer circumferential surface of the plug portion of the cap and the inner wall of the open end of the microtube is decreased so that the contact surface pressure generated is increased. Therefore, the airtightness between the cap and the open end of the microtube is improved.

Since, in the cap for a microtube the length of the grip portion of the cap is longer than the length of the plug portion, the grip portion of the cap can be manually gripped without coming into contact with the plug portion of the cap. Therefore, the handling performance of the cap is improved, and at the same time the samples in the microtube can be prevented from being contaminated.

PREFERRED EMBODIMENTS OF THE INVENTION

Caps for microtubes of the present invention are adapted to be presented in a correct orientation after the caps are aligned on an alignment plate by a cap alignment device having an alignment plate of the same pitch as a storage rack. The alignment plate is placed over the open-ended microtubes vertically accommodated storage rack, and the caps are simultaneously pushed out of the alignment plate toward the open ends of the microtubes to close the open ends. Each cap has a plug portion, which is inserted into the open end of the microtube and a grip portion having an outer circumferential diameter larger than an outer circumferential diameter of the plug portion, and protruding from the open end of the microtube. The entire length of the cap is longer than the pitch of the alignment plate and shorter than twice of the pitch. An upper edge of the grip portion of the cap has a collar with an outer circumferential diameter larger than the receptacles of the alignment plate. The plug portion of the cap has a front part which is tapered toward the front end. The cap is designed so that the center of gravity of the cap is in the plug portion side. Any concrete embodiments of the present invention may be adopted.

A configuration of one embodiment of a cap 100 for a microtube will be described with reference to FIGS. 1 to 7.

Figure 1:
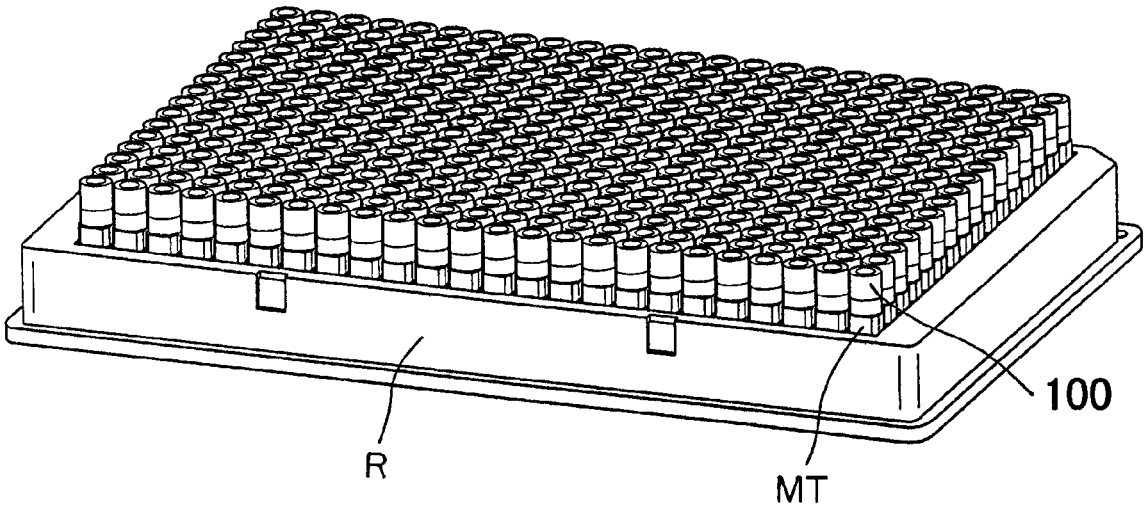
FIG. 1 is a perspective view of microtubes and a storage rack having 384 wells with 16 rows and 24 columns.

FIG. 1 is a perspective view of a rack R with 384 microtubes MT having caps 100 of the present invention. The storage rack R has 384 wells in a matrix with 16 rows and 24 columns in accordance with a standard of SBS, for accommodating the microtubes which have a storage portion MT1 and an open top portion MT2 which is adapted to be closed by a cap 100.

The storage rack R, which has wells in a matrix with 16 rows and 24 columns in accordance with a standard of SBS, accommodates the uncapped microtubes MT. The caps 100 for the microtubes MT are first aligned in an alignment plate P having cells with the same pitch as the storage rack R. The alignment plate P is then placed over the storage rack R so that caps aligned in the cells of the alignment plate are simultaneously registered with the open ends of the microtubes accommodated in the wells of the storage rack. The caps are then pushed through the cells of the alignment plate, as permitted by the elastic compressibility of the cap, whereby the open ends of all microtubes accommodated in the storage rack are closed with caps simultaneously.

Figure 2:
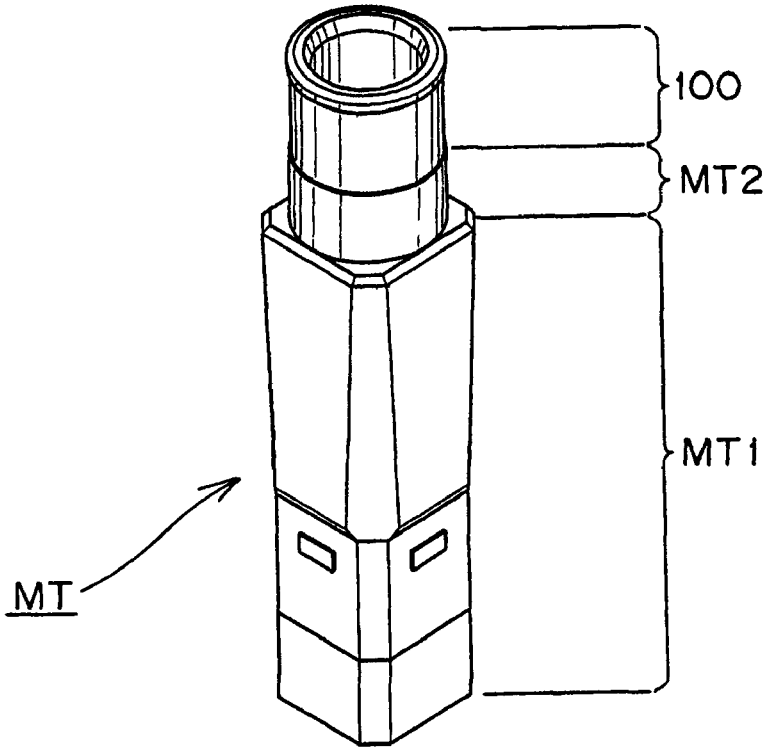
FIG. 2 is a perspective view of a microtube with a cap embodying the present invention.

As shown in FIG. 2, a microtube MT has a rectangular cylindrical body MT1 and is tapered toward its bottom portion and at the same time has chamfered corner portions. Its open end portion MT2 has a cylindrical shape and is molded in a shape into which a cap 100 is fitted. Since this cap 100 is elastically deformed and must pass through a cell in an alignment plate, it is preferably formed of polyethylene or the like excellent in elastic resiliency.

The storage rack R has partitioning walls sectioned to provide wells inside a rack frame. The bottom portions of the above-described microtubes MT are positioned in the matrix of wells. It is noted the shapes of the microtube MT and the storage rack R are not limited particularly if they engage with each other in a stable state.

Figure 3:
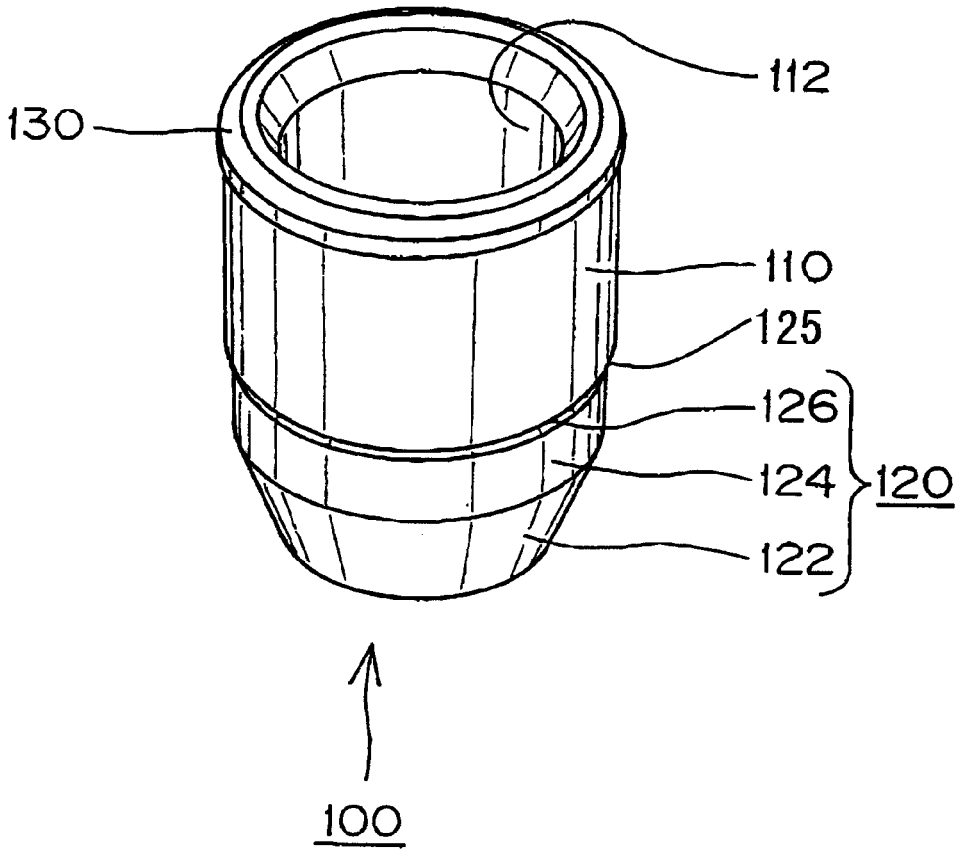
FIG. 3 is a perspective view of the embodiment shown in FIG. 2.
Figure 4:
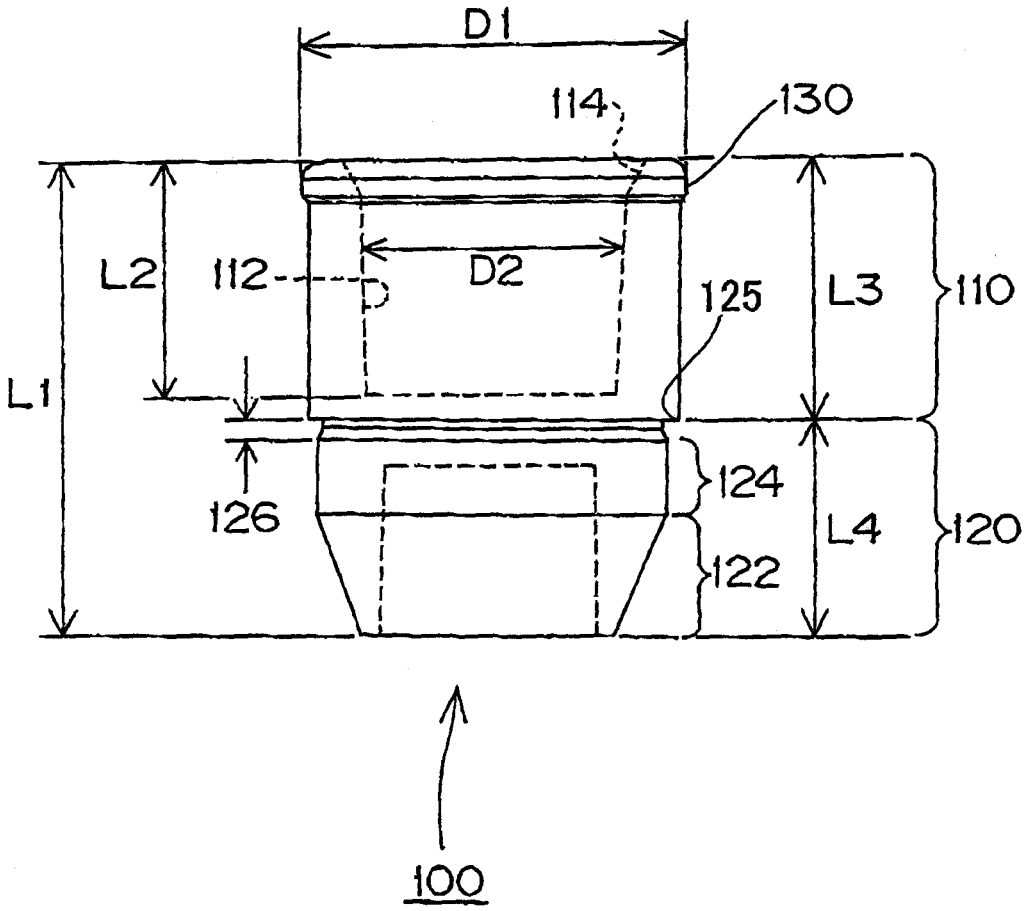
FIG. 4 is a side view of the cap for the microtube shown in FIG. 3.

The cap 100 of the present embodiment will be described with reference to FIGS. 3 and 4. The cap 100 of the present embodiment has, as shown in FIG. 4, a plug portion 120, which is adapted to be inserted into the open end portion MT2 of the microtube MT and a grip portion 110 having a larger outer circumferential diameter than the outer circumferential diameter of the plug portion 120 and is adapted to protrude from the open end of the microtube MT.

Figure 6:
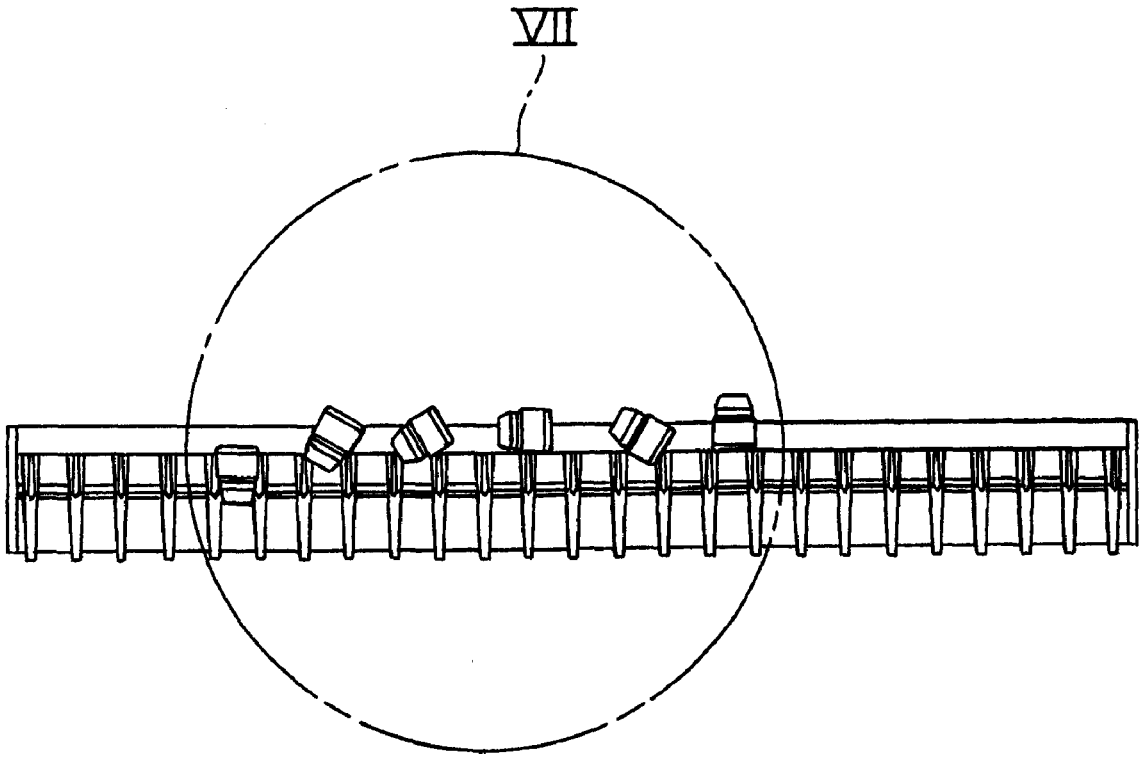
FIG. 6 is a side elevation of the open-sided structure shown in FIG. 5B, as seen from the left.

The entire length L1 of the cap 100 is formed longer than the pitch L5 of the wells of the alignment plate P (see FIG. 6). As a result, the cap 100 is prevented from dropping laterally into any cell of the alignment plate P.

Further, the entire length L1 of the cap 100 is formed shorter than twice of the pitch of the alignment plate. The reason for it is that if the entire length L1 of the cap 100 is more than twice of the pitch L5 of the alignment plate, since the cap 100, which exists on the alignment plate laterally, could span across two or more partitioning walls of the alignment plate in a stable state. Even if the alignment plate is vibrated, such stable caps 100 are difficult to drop into the cells of the alignment plate and efficiency of aligning caps in the alignment plate by use of a cap alignment device is lowered.

Further, at an upper edge of the grip portion 110 of the cap 100, a collar 130 is formed having an outer circumferential diameter D1 larger than the diameter of the cells of the alignment plate. As a result, entry of the top end of the cap 100 into one cell of the alignment plate is prevented. This collar 130 must smoothly pass through the section of the alignment plate in the next step where the alignment plate P is placed over a storage rack R and the open ends of the microtubes accommodated in the storage rack in a tight row are closed by the plug portion 120. Therefore, the collar 130 is designed to be thin and easily deformed.

The plug portion 120 of the cap 100 has a tapered front end portion 122, which is tapered toward the front end. As a result, when the caps 100 are aligned on the alignment plate, they can be easily displaced into the cells of the alignment plate and when the alignment plate P is placed over a storage rack R and open ends of the microtubes are closed by caps 100, the caps 100 are easily displaced into the open ends of the microtubes.

The cap 100 is designed so that the center of gravity CG of the cap 100 is in the plug portion 120 of the cap 100. As a result, when the caps 100 are placed on the alignment plate and the alignment plate is vibrated, the plug portions 120 of the caps 100 are easily displaced into cells of the alignment plate P.

In the upper surface of the grip portion 110 of the cap 100, a concave receptacle 112 is formed for inserting a picking shaft bar. In the present embodiment, the receptacle 112 is circular. When an iron picking shaft bar (not shown) having a diameter slightly larger than an inner circumferential diameter D2 of this concave receptacle 112 penetrates into this concave receptacle 112, the picking shaft bar is closely engaged with the concave receptacle 112 against the elasticity of the cap 100. Thus, a microtube can be pulled out of a rack by penetrating the picking shaft bar into the concave receptacle 112 of the cap accommodated in the rack in a tight row and pulling it up. Therefore, as shown in FIG. 1, even if there is substantially no clearance between caps 100 of adjacent microtubes MT, a predetermined microtube can be reliably pulled out. When a picking shaft bar is attached to an actuator in a robot arm or the like, the picking of microtubes accommodated in the rack having 384 cells in accordance with the standard of SBS in tight rows can be automated. Thus, advantageous effects of this example are very large.

It is noted that in the present embodiment to ensure a close engagement state between the concave receptacle 112 and the picking shaft bar, the depth L2 of the concave receptacle 112 is set to be the same as an inner circumferential diameter D2 of the concave receptacle 112. A chamfer 114 is provided at an inner circumferential edge of the open end of the concave receptacle 112 so that the picking shaft bar is easily fitted into the concave receptacle 112.

A shoulder is formed at the boundary between the plug portion 120 and the grip portion 110 of the cap 100 and a groove 126, which does not come into intimate contact with an inner wall of the open end of the microtube, is formed in the vicinity of the junction between the grip portion 110 and the plug portion 120. Since this groove 126 is provided, the surface area of an airtight fitting surface in a medial part 124 formed between an outer circumferential surface of the plug portion 120 of the cap 100 and the inner wall of the open end of the microtube, is decreased and the contact surface pressure generated at the airtight fitting surface of the part 124 is increased. Thus, the airtightness between the cap 100 and the open end of the microtube is improved. Further, in the present embodiment, the airtight fitting surface of the part 124 is width-widened by a taper of 10 from the groove 126 side toward the taper 122 side and the contact surface pressure is concentrated in the vicinity of the boundary portion between the taper 122 and the airtight fitting surface of the part 124 so that the airtightness is even more improved.

The length L3 of the cap 100 is formed to be longer than the length L4 of the plug portion 120. Accordingly, since the grip portion 110 of the cap 100 can be manually gripped, the handling of the cap is improved.

An alignment plate P for aligning caps of the present example, a change of position of a cap where the cap is aligned in the alignment plate, and an example of a cap alignment device 500, which is used to align the caps in the alignment plate, will be described with reference to FIGS. 5 to 8.

Figure 5:
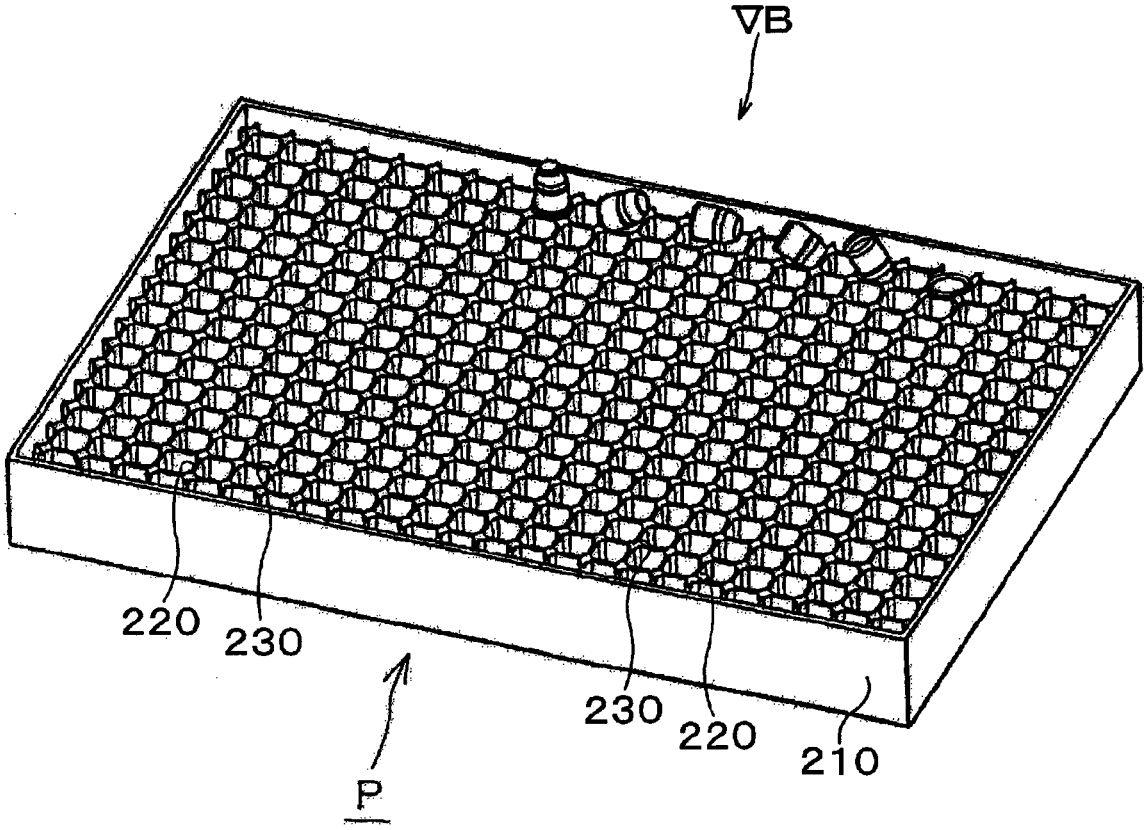
FIG. 5A is a perspective view of an alignment plate for aligning multiple caps of the present invention.
FIG. 5B is an enlarged view of FIG. 5A with a wall of the alignment plate removed.
Figure 5B:
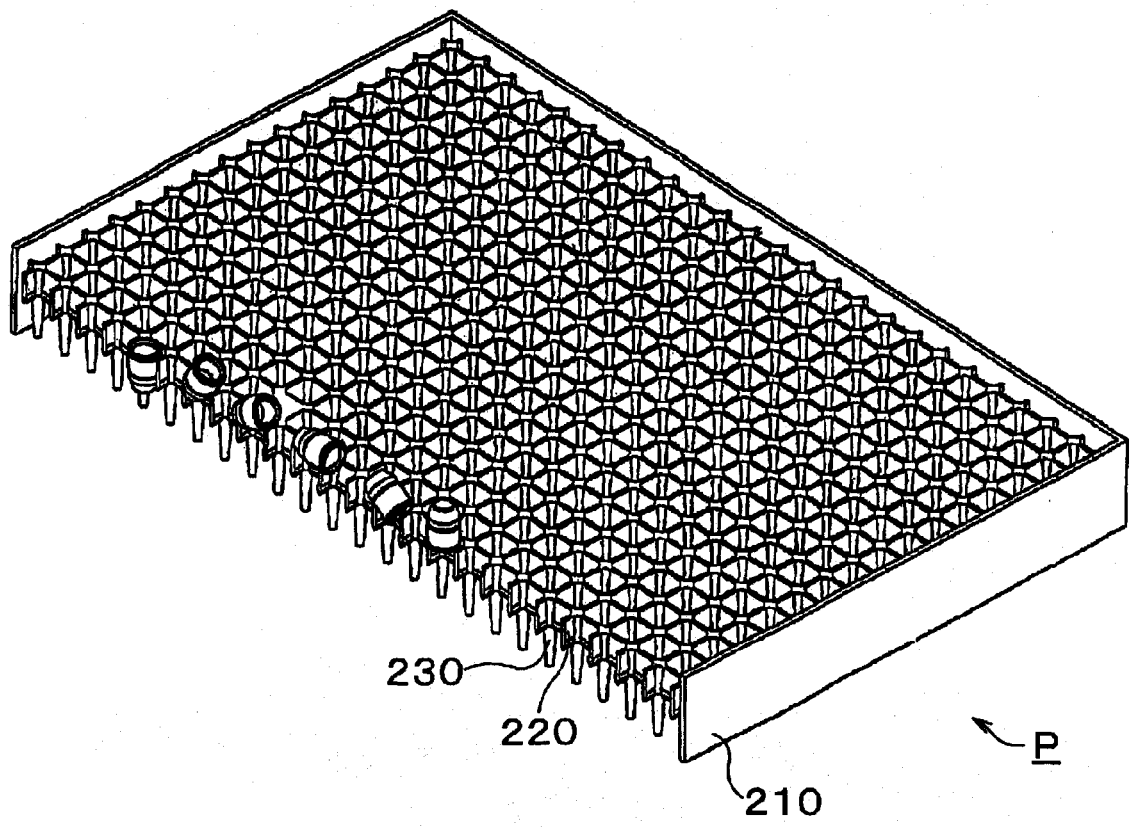
Figure 7:
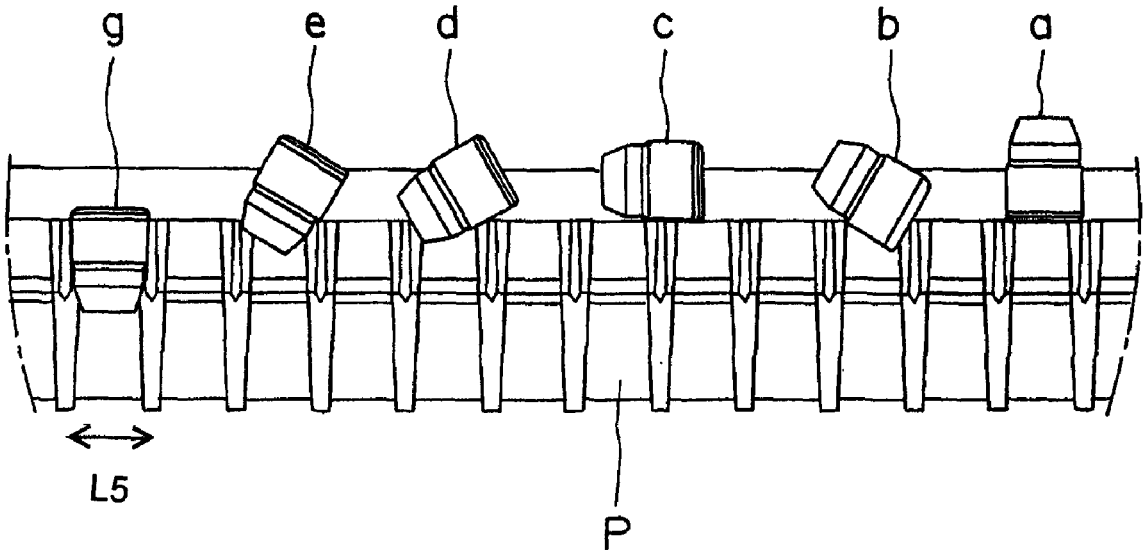
FIG. 7 is an enlarged cross-sectional view of the portion encircled at VII in FIG. 6.
Figure 8:
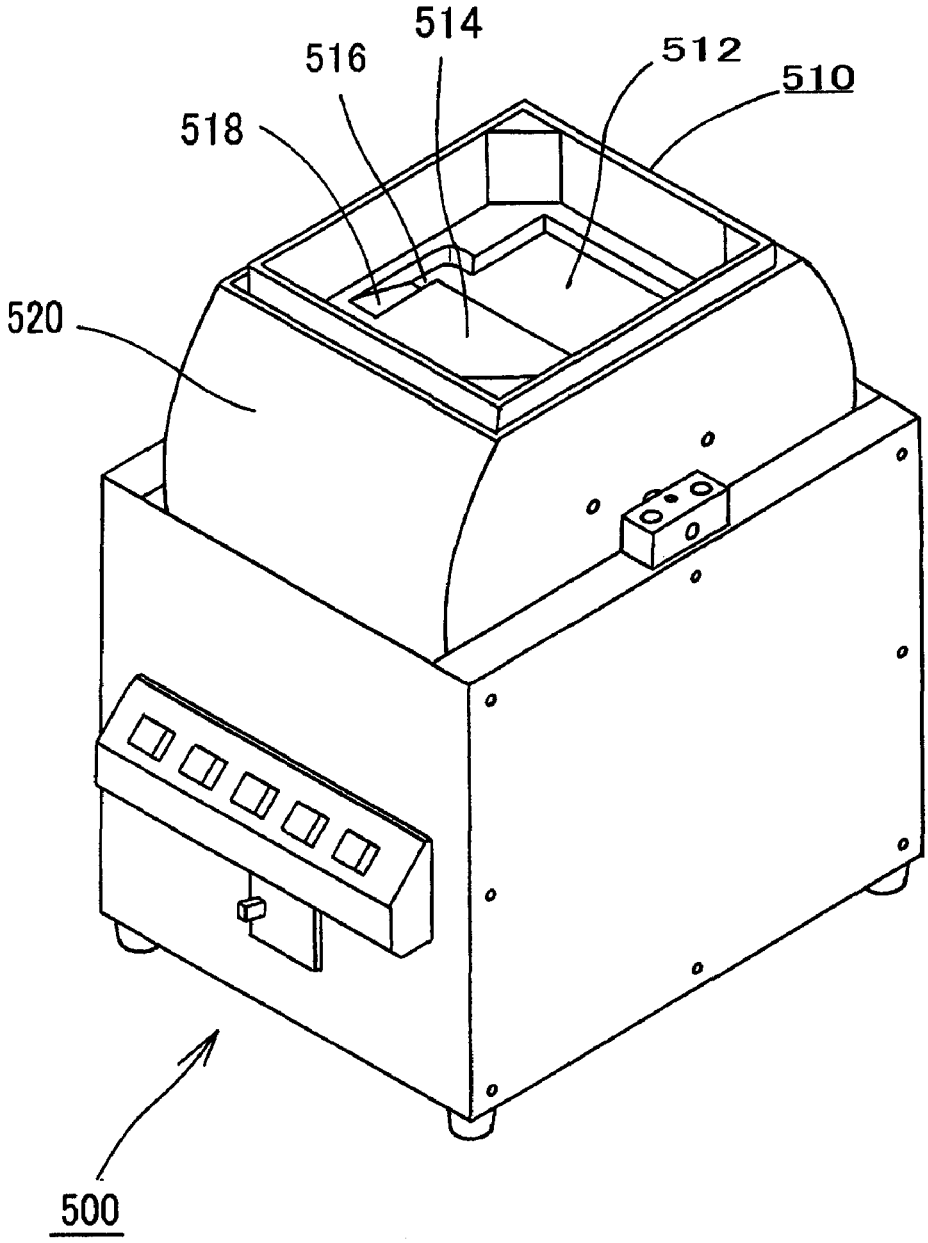
FIG. 8 is a perspective view showing an example of an automatic cap alignment device, which is used when the cap of the present invention is aligned in the alignment plate.

FIGS. 5A and 5B are perspective views showing an alignment plate P for aligning a cap of the present example together with six caps. FIGS. 7 and 8 show caps in different orientations prior to their alignment in the cells of the plate.

The caps of the present example are adapted to be aligned with an alignment plate P having a rectangular frame 210 with longitudinal (220) and transverse (230) partitions forming cells having the same pitch L5 (see FIG. 7) as the wells of the storage rack R as shown in FIGS. 5A and 5B. To align the cap in the alignment plate P, a cap alignment device 500 as shown in FIG. 8 may be used. This cap alignment device 500 has a vibration box 510 whose top is opened at an uppermost portion of the device. In this vibration box 510 are juxtaposed an alignment plate attaching portion 512, which accommodates an alignment plate. The box 510 has the required depth and a cap retaining portion 514 to receive and retain a large number of non-aligned caps.

Groove portions 516 communicating with the cap retaining portion 514 are formed on both sides of the alignment plate attaching portion 512 in a shape in which the groove portion 516 has the alignment plate attaching portion 512 and a ramp 518, which bypasses the step between the cap retaining portion 514 and the plate attaching portion 512. This vibration box 510 is covered with arc-shaped covers 520 at two surfaces except for the opening surface of the top and has a pivoting mechanism, which alternately vertically tilts the alignment plate attaching portion 512 and the cap retaining portion 514 back and forth by using the center of the arc of this arc-shaped cover 520 as a shaft, in the device. Further, the vibration box 510 includes a vibration mechanism, which provides the alignment plate with vibration as it is tilted back and forth with the box 510 and the alignment plate attaching portion 512.

When the alignment plate is mounted on the alignment plate attaching portion 512, a number of caps are put into the vibration box 510. To actuate the cap alignment device 500, the vibration box 510 is tilted back and forth so that caps are spread over the alignment plate and at the same time the vibration applied to the alignment plate causes the caps to drop into the cells of the alignment plate with the plug portions of the caps downward. At the stage where there are caps displaced into all cells of the alignment plate, the cap alignment device 500 is stopped with the alignment plate attaching portion 512 upward and the alignment plate is removed.

An example of the movement of a cap until the cap is dropped into one cell of the alignment plate P will be described with reference to FIG. 7. FIG. 7 shows a state where six caps exist on the alignment plate P. However, although the six caps are shown as individual caps, the drawing illustrates six typical orientations any cap may assume on the plate. A cap a, is shown upside down on the alignment plate, and caps b through e show a changing orientation of the cap on the partitions between the cells of the alignment plate P, it is finally directed to a correct orientation that may be is dropped into one cell of the alignment plate as shown with cap g.

It is supposed that an upside-down cap overlies on one cell of the alignment plate P like the cap a. In this case, since in the cap of the present invention an upper edge of a grip portion of the cap has a collar having an outer circumferential diameter larger than the diameter of the cells of the alignment plate P, the upside-down cap does not fit into the cell of the alignment plate P. When vibration is given to the alignment plate P, a part of the grip portion of the cap is displaced into a cell of the alignment plate P like the cap b. At this time, since the entire length of the cap is larger than the pitch of the alignment plate P, the cap of the present invention does not fit into the underlying cell of the alignment plate P laterally. Further, since the center of gravity CG of the cap is in the plug portion side, the cap of the present invention is placed on a partitioning wall of the alignment plate P like the cap c by vibration given to the alignment plate P. Since the center of gravity CG of the cap is in the plug portion side and the front part 122 of the plug portion has a taper toward the front end as described above, the cap of the present invention gradually changes the orientation like the cap d and the cap e by vibration given to the alignment plate P and it is finally displaced into the cell of the alignment plate P in an appropriate state where the plug portion is directed downward like the cap g.

It is noted that in the above descriptions, there is a change of orientation of the cap from a state where a cap is upside down on one cell of the alignment plate P like the cap a to an orientation where the cap is finally displaced into a cell of the alignment plate P in an appropriate orientation where the plug portion is directed downward like the cap g. However, according to the cap of the present invention, even if any orientation exists on the alignment plate P at the starting of the cap alignment device, caps are displaced into all cells in an appropriate state for short time.

The caps for the microtubes are effective to close the open ends of the microtubes accommodated in a storage rack having 16 rows and 24 columns of wells simultaneously by use of an alignment plate. Thus, the present invention contributes to high efficiency of studying pharmaceutical development, resource-savings by repeated utilizing of caps and the like.

The invention claimed is:

1. A plurality of caps for microtubes for use with a tube-storage rack having wells arranged in a matrix, and an alignment plate adapted to overlie the storage rack, and having cells with open tops and bottoms arranged in an identical matrix, the alignment plate having intersecting partitions forming a grid dividing the plate into the matrix of cells, the matrix of cells having a pitch equal to the pitch of tube-receiving wells of the tube-storage rack, the wells adapted to receive a plurality of microtubes having open upper ends, the alignment plate adapted to receive a plurality of said caps and being operable to align the caps with the cells of the alignment plate for displacement into the open ends of microtubes positioned in the wells of the storage rack, and after the alignment plate is placed over the storage rack, allow the aligned caps to be simultaneously pushed through the cells into the open ends of the microtubes to close the open ends, characterized in that each of said plurality of caps for microtubes has a plug portion at a front end, which is dimensioned to be inserted into the open end of the microtube, and a grip portion at the rear end having an outer circumferential diameter larger than an outer circumferential diameter of said plug portion, and dimensioned to protrude from the open end of the microtube, the entire length of each said cap including said plug portion and said grip portion is longer than the pitch of the alignment plate cells, and shorter than twice said pitch, each said cap being composed of a resilient compressible material of sufficient resilience to be compressed when said cap is pushed through the alignment plate cell into the open end of the microtube in the race, said grip portion has a rear edge surrounded by an easily deformable collar having an outer circumferential diameter larger than the diameter of the alignment plate cells, said collar preventing entry of the grip portion into the cells of the alignment plate until said collar is deformed when said caps are pushed through the cells into the open upper ends of the microtubes in the wells, said plug portion of said cap has a tapered front end part which is tapered toward said front end, and said cap has a center of gravity within said plug portion to cause said front portion of said cap to fall into the open top of one of the cells of the alignment plate for pushing into the open end of the microtube in the underlying well.

2. The plurality of caps for a microtube according to claim 1, characterized in that a concave receptacle is formed in a rear surface of said grip portion of said cap, said receptacle dimensioned to receive a picking shaft bar.

3. The plurality of caps for a microtube according to claim 1, characterized by a shoulder at the forward end of said grip portion of said cap, and a groove separating said shoulder from the plug portion, said groove providing a space between said grip portion and said plug portion that does not come into intimate contact with the open end of said microtube.

4. The plurality of caps for a microtube according to claim 3, wherein said plug portion has a medial part between said groove and said tapered front end part, said medial part having a slight outward taper toward said front end part of said cap, whereby said cap seals the open end of the tube at the junction between said medial part and said tapered front part.

5. The plurality of caps for a microtube according to claim 1, characterized in that the length of said grip portion of said cap is longer than the length of said plug portion.

6. For use with a tube-storage rack having tube-receiving wells arranged in a matrix of wells, the combination of a plurality of caps for the tubes and an alignment plate adapted to overlie the storage rack, said plate having cells with open tops and bottoms arranged in an matrix of cells identical to the matrix of wells, said alignment plate having intersecting partitions forming a grid dividing the plate into said matrix of cells having a pitch equal to the pitch of tube-receiving wells of the tube-storage rack and a given transverse dimension, the wells adapted to receive a plurality of tubes having open upper ends, said alignment plate dimensioned to receive a plurality of said caps and being operable to align the caps with the cells of the alignment plate for displacement into the open ends of tubes positioned in the wells of the storage rack, and after the alignment plate is placed over the storage rack, to allow the aligned caps to be simultaneously pushed through the cells into the open ends of the tubes to close the open ends, characterized in that each of said plurality of caps has a plug portion at a front end having an outer circumferential diameter less than said given transverse dimension, and adapted to be inserted into the open end of the tube, and a grip portion at the rear end having an outer circumferential diameter larger than said outer circumferential diameter of said plug portion, and dimensioned to protrude from the open end of the tube, the entire length of said cap including said plug portion and said grip portion is longer than the pitch of the alignment plate cells, and shorter than twice said pitch, said grip portion has a rear edge surrounded by an easily deformable collar having an outer circumferential diameter larger than said given transverse dimension of the alignment plate cells, said collar being composed of an easily compressible material operable to be compressed in transverse dimension to less than said given transverse dimension when said cap is pushed through the alignment plate cell into the open end of the microtube in the rack, said collar arresting entry of the grip portion into the cells of the alignment plate until said collar is compressed when said caps are pushed through the cells into the open upper ends of the microtubes in the wells, said plug portion of said cap has a tapered front end part which is tapered toward said front end, and said cap has a center of gravity within said plug portion to cause said front portion of said cap to fall into the open top of one of the cells of the alignment plate for pushing into the open end of the tube in the underlying well.

* * * * *